United States Patent [19]

Mills

[11] Patent Number: 4,626,194

[45] Date of Patent: Dec. 2, 1986

[54] FLOW REGULATING DEVICE

[75] Inventor: Paul Mills, Penn, England

[73] Assignee: Stordy Combustion Engineering Limited, Wolverhampton, England

[21] Appl. No.: 543,637

[22] Filed: Oct. 19, 1983

[30] Foreign Application Priority Data

Oct. 19, 1982 [GB] United Kingdom ..... 8229806

[51] Int. Cl.[4] ..... F23N 1/00

[52] U.S. Cl. ..... 431/90; 137/100; 137/329.01

[58] Field of Search ..... 431/90, 38, 19; 236/16 B, 16 A, 16 R, 16 D, 15 BD, 15 C; 137/100, 484.4, 484.6, 484.8, 507, 500, 329.01

[56] References Cited

U.S. PATENT DOCUMENTS

| | | | |
|---|---|---|---|
| 2,067,229 | 1/1937 | Birch | 137/329.01 X |
| 2,482,401 | 9/1949 | Chandler | 137/100 X |
| 2,558,921 | 7/1951 | Barr | 137/100 X |
| 2,565,329 | 8/1951 | Stresen-Reuter | 137/100 X |
| 3,827,849 | 8/1974 | Nelson | 431/90 |
| 4,020,861 | 5/1977 | Shihabi | 137/100 |
| 4,302,178 | 11/1981 | Belknap et al. | 431/90 X |

FOREIGN PATENT DOCUMENTS

| | | |
|---|---|---|
| 249590 | 4/1926 | United Kingdom . |
| 889681 | 6/1962 | United Kingdom . |

OTHER PUBLICATIONS

Copy of the British Search Report dated 22/11/83.

*Primary Examiner*—Randall L. Green

*Attorney, Agent, or Firm*—Fulwider, Patton, Rieber, Lee & Utecht

[57] ABSTRACT

Means for supplying liquid or gaseous fuel to a burner includes a flow regulating device having three coaxial diaphragms, between each adjacent pair of which there is defined a chamber, these chambers being connected with respective sensing stations in an air flow path to the burner. Outer faces of the outer diaphragms are subjected respectively to pressures derived from sensing stations in the fuel flow path and the diaphragms are connected with one another and with a valve for controlling the rate of flow of fuel.

8 Claims, 1 Drawing Figure

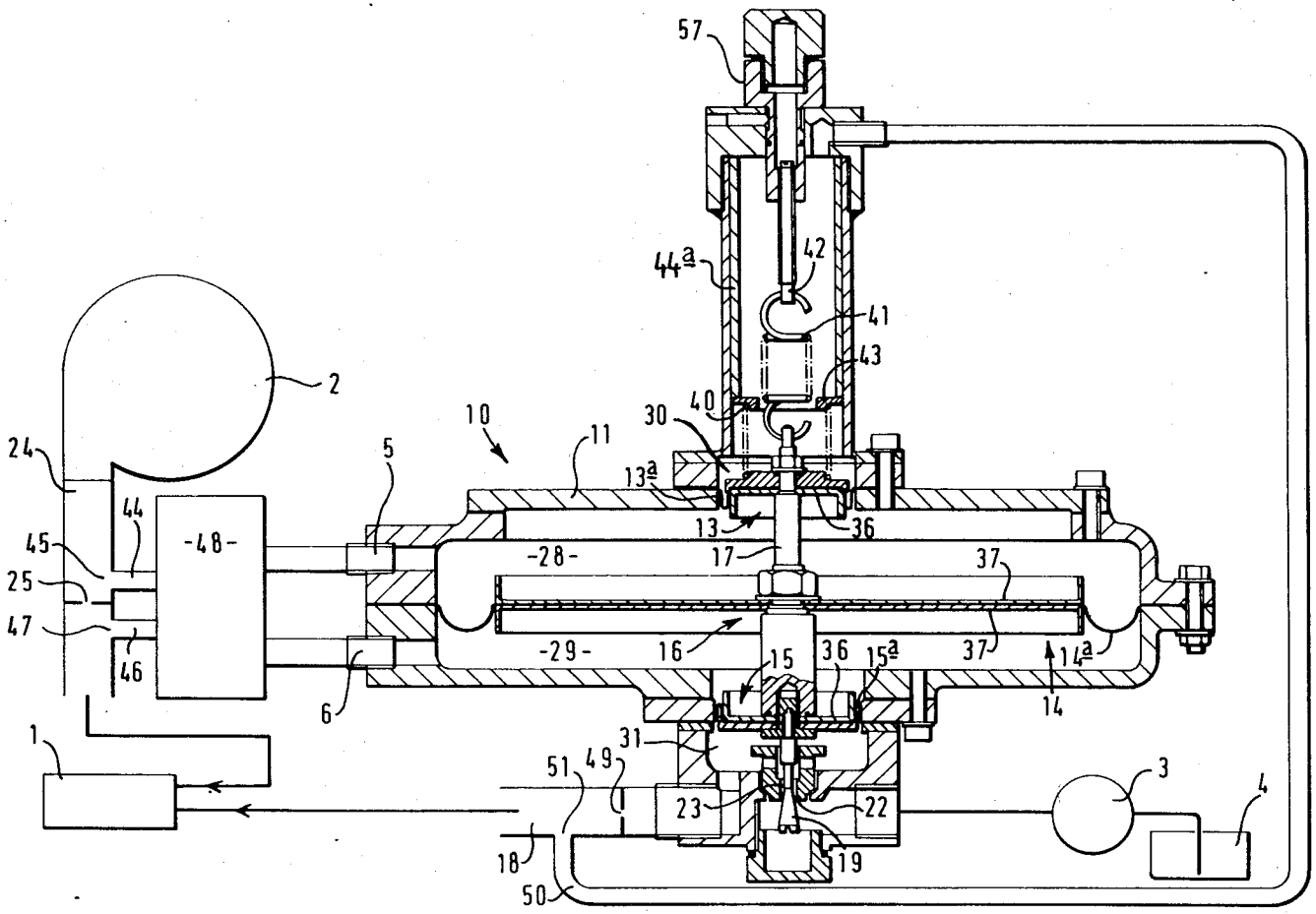
-28-
-29-
-48-

FLOW REGULATING DEVICE

BACKGROUND OF THE INVENTION

1. Field of the Invention

This invention relates to apparatus comprising a burner and conveying means defining an air passage for conveying air to the burner and a fuel passage for conveying fuel to the burner, the conveying means being adapted to control the rate of flow of fuel in accordance with the rate of flow of air to maintain a constant fuel to air ratio at the burner when the rate of flow of air is varied.

2. Prior Art

Apparatus of the kind referred to which is commonly used at the present time has a regulator which includes a valve member movable relative to a body of the regulator to open and close an orifice through which the fuel flows, a first diaphragm which is connected with the valve member and which separates two chambers connected with the air flow path upstream and downstream respectively of an orifice in the air flow path and a second diaphragm which is also connected with the valve member and which separates two further chambers in or connected with the fuel flow path at opposite sides of an orifice in the fuel flow path. One of the chambers connected with the air flow path is adjacent to one of the chambers connected with the fuel flow path and it is necessary to prevent leakage between these chambers, whilst allowing unimpeded movement of the valve member. Sliding seals which are capable of preventing significant leakage interfere with movement of the valve member and prevent the required fuel to air ratio being maintained at the burner. For this reason, regulators generally used at the present time have a third diaphragm which separates the adjacent air and fuel chambers and a central portion of which is sealed to the valve member. During use of these known regulators, the third diaphragm exerts on the valve member a force which is related to the difference in pressure between the adjacent air and fuel chambers. Particularly in a case where the pressure in the air chamber is substantially different from the pressure in the fuel chamber, this force prevents the predetermined air to fuel ratio being maintained at the burner when there are substantial changes in the air flow rate.

Numerous devices comprising three diaphragms connected with a common central member have been proposed but none of these proposals has solved the problem of maintaining a predetermined air to fuel ratio at a burner when large changes are made in the air flow rate. It will be understood that burners may be required to operate with a flow rate which is only one tenth of the maximum flow rate at which the burner can be operated. The problem is further compounded by considerable differences between the absolute pressures at which air and fuel are made available to a burner. For example, in the case of oil fuel, oil is generally supplied at a pressure in the region of 100 p.s.i.; whereas air is generally supplied at a pressure in the region of 1 p.s.i. In contrast with this, gaseous fuel is often available to the burner only at a pressure below that of the air supply.

Examples of devices having three diaphragms connected with a common central member are disclosed in U.S. Pat. No. 2,886,698 issued to Johnson et al May 19, 1959. This Patent discloses devices which respond to the establishment of a predetermined ratio between two fluid pressures by providing an output signal, for example operating an electrical switch. The device includes a venturi to provide a reference ratio which is the ratio of the pressure at which gas flows to the venturi and the pressure at the throat of the venturi. Two of the chambers are connected with the venturi so that these pressures are exerted on appropriate diaphragms. The two pressures which are to be compared are applied to two other chambers. In each device illustrated in the Johnson et al Patent, the diaphragms are very different in size. The devices disclosed in the Johnson et al Patent are not flow regulating devices and the sets of diaphragms disclosed would not be useful in solving the problem of accurate flow regulation, owing to the large difference in size between the two or three members of each set.

A further device comprising three diaphragms connected with a common central member has been proposed in French Pat. No. 2,264,999 of Fr. Sauter AG Fabrik Elektr. Apparate, published on 17th October 1975. This device is a fluid pressure amplifier and the member connected with the diaphragms is a valve for controlling the fluid pressure maintained in one chamber of the device. As explained in the French Specification, the device illustrated in FIG. 1 thereof is not satisfactory as an amplifier and the device would not solve the problem of accurate control of the rate of flow of fuel to a burner. The French Specification proposes that a device having only two diaphragms and two annular, flexible seals should be used to achieve improved results.

A device which is intended to control accurately the rate of flow of fuel to a burner is disclosed in U.S. Pat. No. 3,101,897 issued Aug. 27th, 1963 to Vaughn. The Vaughn device comprises three diaphragms connected with a valve by a tubular member which passes through the centres of the diaphragms. This tubular member provides direct communication between outer chambers of the device, one of these communicating with the fuel flow path at a position downstream of the valve orifice. Intermediate chambers of the device are subjected to respective pressures at spaced positions along the air flow path. Any variation in the back pressure in the fuel flow path between the flow regulator and the burner would prevent maintenance of the required air to fuel ratio at the burner. Similarly, any variation in the pressure at which fuel is supplied to the regulating device would also prevent the required ratio being maintained.

An earlier proposal for a device capable of maintaining the required relation between fuel and air flow rates to a burner is disclosed in British Pat. No. 120,076 of Keith, accepted Oct. 21st, 1918. The flow regulating device described in the Keith Patent has only two diaphragms, these being connected together to a valve in the fuel flow passage. A space between the diaphragms is divided by a rigid wall into chambers which communicate with one another via an adjustable orifice. These chambers are both in the fuel flow path. Outer faces of the diaphragms, which have equal areas, are connected with respective positions spaced apart along the air flow path. The Keith device will be in equilibrium only when the pressure drop between these positions in the air flow path is exactly equal to the pressure drop between the two chambers in the fuel flow path. However, equal pressure drops are generally unsatisfactory. Ideally, the pressure drop in the air flow path and the pressure drop in a gaseous fuel flow path are both preferably about 10% of the supply pressure. Since the air supply pressure is normally considerably greater than the gas supply pressure, maintenance of equal pressure drops in the two flow paths would prevent the use of 10% pressure drops in one or other of the flow paths. The problem is even more pronounced in the case of an oil burner, where the supply pressure of the oil is likely to be 100 times greater than the air supply pressure. Clearly, equal pressure drops in this case would be impracticable. At same value of the pressure drop in the oil flow path below 5 p.s.i., the flow would become laminar and the proportional relation between flow rate and the square of the pressure drop would be lost so that accurate control of the oil flow rate in accordance with the air flow rate would be impossible.

SUMMARY OF THE INVENTION

Apparatus according to the present invention comprises a burner and conveying means defining an air passage for conveying air to the burner and a fuel passage for conveying fuel to the burner, wherein the conveying means comprises a hollow body defining a valve orifice in the fuel passage, a valve member for restricting the valve orifice, the valve member being disposed within the body and being movable relative thereto, two outer diaphragm assemblies and an intermediate diaphragm assembly, each diaphragm assembly having a peripheral portion mounted on the body and a central portion mounted on the valve member, means defining an air orifice in the air passage and means defining a fuel orifice in the fuel passage, wherein the intermediate diaphragm assembly is disposed between the outer diaphragm assemblies to divide into a pair of intermediate chambers a space in the body between the outer diaphragm assemblies, wherein the outer diaphragm assemblies define, in conjunction with the body, respective outer chambers connected with respective sensing stations at opposite sides of the fuel orifice in the fuel passage and wherein said intermediate chambers are connected with respective sensing stations in the air passage at opposite sides of the air orifice.

The respective areas of the two outer diaphragm assemblies which are exposed to the fluid pressures may be equal. Alternatively, the respective areas of these assemblies differ slightly, the divergence from exact equality being such as to compensate for the force exerted on the valve member when subjected to pressure by one of the fluids. In this case, the difference between the respective areas of the diaphragm assemblies would be of the same order as the area of the valve member subjected to fluid pressure in the valve orifice.

The chambers may communicate directly with pressure sensing stations in the flow paths. Alternatively, one pair of the chambers may communicate with corresponding pressure sensing stations in one of the flow paths via a pressure amplifier. In a case where one of the chambers is included in one of the flow paths, that chamber would communicate directly with a sensing station in the flow path immediately adjacent to the chamber, where the pressure would be equal to that in the chamber itself.

In a case where the apparatus is to be used for conveying oil to a burner at a pressure which is many times greater than the pressure at which air is supplied through the apparatus to the burner, the effective area of the outer diaphragm assemblies would be small, relative to the effective area of the intermediate diaphragm assembly.

BRIEF DESCRIPTION OF THE DRAWING

The accompanying drawing represents partly diagrammatically and partly in cross-section one example of apparatus in accordance with the invention for conveying a fluid fuel and air to a burner.

DESCRIPTION OF THE PREFERRED EMBODIMENT

The apparatus illustrated in the accompanying drawing comprises a burner 1 which would, typically, be mounted in a wall of a furnace (not shown). For supplying air to the burner, there is provided a blower 2 and for feeding an oil fuel to the burner, there is provided a pump 3 associated with a bulk separator of oil 4. For conveying air from the blower to the burner and conveying fuel from the pump to the burner, there is provided conveying means which defines respective passages 24 and 18 for the air and fuel and which includes a flow regulating device 10. The flow regulating device is shown in some detail in the drawing. Other parts of the apparatus are represented diagrammatically only.

The rate at which air is supplied to the burner 1 is determined primarily by means of an adjustable throttle (not shown separately) which is incorporated in the blower 2. This rate is varied according to the heat output required from the burner. Typically, the throttle of the blower may be adjustable steplessly to provide a range of flow rates, the maximum value of which is ten times the minimum value. Even when the setting of the throttle is maintained constant, variations in the rate of air flow to the burner may arise from variations in the air pressure at the blower inlet or variations in the combustion chamber into which the burner 1 fires. The regulating device 10 is intended to maintain a predetermined ratio between the rate of flow of air to the burner 1 and the rate of flow of fuel to the burner under all operating conditions.

The regulating device 10 comprises a hollow body 11 in which there are mounted three diaphragm assemblies 13, 14 and 15 respectively. In the arrangement illustrated, these diaphragm assemblies are spaced apart from one another vertically with one of the outer diaphragm assemblies, 13, being uppermost and the other outer diaphragm assembly, 15, being lowermost. The regulating device further comprises a valve member 16 which is disposed within the body 11 and which is movable upwardly and downwardly relative to the body. The diaphragm assemblies are horizontal and coaxial with the valve member.

There is defined in the body 11 between the outer diaphragm assemblies 13 and 15 a space which is divided by the intermediate diaphragm assembly 14 into chambers 28 and 29. The diaphragm assembly 14 comprises a diaphragm **14*a* and plates 37 between which a central portion of the diaphragm is clamped. The diaphragm assemblies 13 and 15 comprise respective diaphragms 13*a* and 15*a* clamped by respective plates 36 and have at least approximately equal effective areas. A peripheral portion of each diaphragm is mounted on the body 11 in a fluid-tight manner. The valve member 16 includes a plunger 17 on which central parts of the diaphragms are mounted by means of the clamping plates 36 and 37, also in a fluid-tight manner. The plunger is of solid construction and the combination of plunger and diaphragm assemblies is therefore adapted to prevent leakage of fluid between the chambers 28 and 29 and between these intermediate chambers and outer chambers lying beyond the diaphragm assemblies 13 and 15** respectively.

In the air flow passage 24 leading from the blower 2 to the burner 1, there is provided means defining an orifice 25. Respective sensing stations 45 and 47 in the air flow passage upstream and downstream of the orifice 25 are connected with the chambers 28 and 29. This connection may be direct or, as illustrated, indirect. The chamber 28 is defined between a downwardly facing surface of the upper diaphragm assembly 13, an upwardly facing surface of the intermediate diaphragm assembly 14 and adjacent inwardly facing surfaces of the body 11. In a part of the body at the periphery of the chamber 28, there is formed a through bore 5. The chamber 29 is defined between an upwardly facing surface of the lower diaphragm assembly 15, a downwardly facing surface of the intermediate diaphragm assembly and adjacent inwardly facing surfaces of the body, a through bore 6 extending from one of these surfaces of the body to the exterior of the body. The through bores 5 and 6 are connected via a known fluid pressure amplifier 48 with respective branch passages 44 and 46 communicating with the air flow passage at the sensing stations. In a case where the chambers 28 and 29 are connected directly with the sensing stations, the branch 44 would lead directly to the bore 5 and the branch 46 directly to the bore 6. Thus, as shown in the drawing, while interactively juxtaposed to each other through the intermediate diaphragm 14*a*, the chambers 28 and 29 are internally isolated or remote from each other.

The fuel flow path 18 from the pump 3 to the burner 1 extends through a part of the body 11. A valve seat 22 of the body defines a valve orifice 23 in the fuel flow path 18 and a valve head 19 of the valve member 16 is movable relative to the seat to vary the degree of restriction of the orifice 23. The valve head is preferably of tapered form and is engageable with the seat 22 to close the orifice 23. The unobstructed area of the orifice 23 can be varied steplessly by upward and downward movement of the valve member 16.

There is associated with the valve member 16 biasing means which includes springs 40 and 41 disposed above the upper diaphragm assembly 13. The spring 41 is coupled at one of its ends with the plunger 17 adjacent to the upper end thereof and is coupled at its other end with an adjustment member 42. This adjustment member is mounted in an upper part of the body 11 for screwing towards and away from the lower part of the body to vary the tension in the spring 41. The adjustment member 42 is externally threaded and forms a part of a screw and nut mechanism for adjustment of the tension in the spring 41. This mechanism further comprises an internally threaded bush 57 which is in threaded engagement with the adjustment member and extends through an aperture in an upper end of the body 11 so that torque can be applied to the bush at a position outside the body. The central bore of the bush is sealed off by a plug carried on that part of the bush which lies outside the body. The spring 40 is subject to compression and acts between an upper plate of the upper diaphragm assembly 13 and a ring 43 provided in the body 11 and restrained against movement away from a lower part of the body by a sleeve 44*a*. There is no provision for adjustment of the compression of spring 40, although small changes in the degree of compression of this spring will occur when the valve member moves upwardly and downwardly relative to the body.

The spring 41 counteracts the weight of the plunger assembly 17. Adjustment of the position of the adjusting member 42 relative to the body 11 enables the position of the valve head 19 to be adjusted to a selected position relative to the seat 22 when the respective flow rates of air and fuel are zero or under any other conditions which occur during use of the apparatus.

There is defined between the lower face of the lower diaphragm assembly 15 and an adjacent part of the body an outer chamber 31 which forms a part of the fuel flow path 18. The valve orifice 23 leads from an inlet of the regulating device to the chamber 31. At a position in the fuel flow path downstream of the valve orifice 23 and of the chamber 31, there is provided means defining an orifice 49. The chamber 31 communicates directly with a sensing station in the fuel flow path upstream of the orifice 49.

A fourth chamber 30 is defined by an upwardly facing surface of the upper diaphragm assembly 13 and by adjacent surfaces of the body 11. This fourth chamber is connected by a duct 50 with a sensing station in the fuel flow passage 18 downstream of the orifice 49.

One or both of the orifices 25 and 49 may be adjustable, so that they enable the ratio of the rates of flow of fuel and air along the paths 18 and 24 to be set to a required value.

Whilst air flows from the blower 2 to the burner 1, a pressure drop will be maintained across the orifice 25. Air present in the chamber 28 will be maintained at a pressure higher than that of air in the chamber 29. The pressure at the sensing station 45 is related to the pressure in the chamber 28 by the same factor as the pressure at the sensing station 47 is related to the pressure in the chamber 29. Similarly, there will be a pressure drop across the orifice 49 whilst fuel is flowing from the pump 3 to the burner and the pressure of fuel in the chamber 31 will be maintained at a higher value than that of fuel in the chamber 30.

It can be shown that the ratio of rates of flow of fuel and air along the passages 18 and 24 is maintained as a constant by the device when the rate of air flow is changed as follows:

Let $P_1$=air pressure in the first chamber (29);

$P_2$=air pressure in the second chamber (28);

$P_3$=fuel pressure in the third, lowermost, chamber (31);

$P_4$=fuel pressure in the fourth, uppermost, chamber (30).

Let

X=the effective surface area of the upper and lower diaphragm assemblies;

Y=the surface area of the middle diaphragm assembly.

The net upward force due to fuel pressure in the third and fourth chambers is:

$$P_3X - P_4X = P_FX$$

where $P_F$ is the difference in fuel pressures between the third and fourth chambers.

The net downward force due to air pressure in the first and second chambers is:

$$P_1X - P_1Y + P_2Y - P_2X = (P_2 - P_1)(Y - X)$$
$$= P_A(Y - X)$$

where $P_A$ is the difference in air pressures between the first and second chambers.

When the plunger assembly is in an equilibrium position, the force on the plunger assembly exerted by the spring, counterbalances the weight of the plunger assembly, and the thrust due to fuel pressure acting on the valve head element 19. The net opening force due to the pressure of air in the first and second chambers is substantially equal and opposite to the net closing force due to the pressure of fuel in the third and fourth chambers, that is:

$$P_F X = P_A(X - Y)$$

$$\text{i.e. } \frac{P_F}{P_A} = \frac{X}{X - Y}$$

The ratio $$\frac{P_F}{P_A}$$

is a constant. Since $P_F$ is a measure of the rate of flow of fuel along the second flow passage 18 and $P_A$ is a measure of the rate of flow of air along the first flow passage 24, it can be seen that the ratio of these rates of flow is a constant. The device ensures that the ratio remains a constant when one of the rates of flow (that of the air) is changed. It is assumed that under all conditions of operation, the rates of flow of air and fuel are such that the pressure drop across each of the orifices 25 and 49 is proportional to the square of the flow rate concerned. It is also assumed that the effective areas of the outer diaphragm assemblies 13 and 15 are equal.

If the predetermined relation between the rate of flow of air and the rate of flow of fuel were required to be non-linear, this could be contrived by making the upper and lower diaphragm assemblies 13 and 15 of unequal areas.

In practice, the fuel exerts a thrust on the valve head 19. In many cases, particularly where the pressure in that part of the fuel flow passage 18 which extends from the orifice 49 to the burner 1 does not change, the pressure on the valve head does not disturb the required relation between the air flow rate and the fuel flow rate. In other cases, compensation for the effect of the pressure exerted by the fuel on the valve head 19 is achieved by providing outer diaphragm assemblies 13 and 15 with slightly different effective areas. The difference in effective area is of the same order as the minimum cross-sectional area of that part of the valve member 16 which is exposed to the fuel in the chamber 31 and the valve orifice 23. This part of the valve member 16 constitutes a stem on which the head 19 is carried. As shown in the drawing, the maximum diameter of the head 19 is substantially greater than is the diameter where said cross-sectional area is a minimum, but is a plurality of times smaller than are the diameters of the outer diaphragm assemblies 13 and 15.

In a case where the fuel is oil in a liquid condition, the orifice 23 and the valve head 19 are both small and the difference between the effective areas of the outer diaphragm assemblies is a small fraction of the effective area of one of these, not more than 5% and typically 1%.

Apparatus in accordance with the present invention may be used for supplying a gaseous fuel and air to a burner. In this case, the apparatus illustrated in the accompanying drawing would be modified somewhat. The pump 3 and oil tank 4 would be omitted, the fuel inlet of the regulating device being connected directly to a gas main. The burner 1 would be a gas burner and the cross-sectional area of the fuel flow passage 18 would be increased, as compared with the cross-sectional area which is necessary for the supply of a liquid fuel. The size of the orifice 23 and the size of the valve head 19 also would be increased considerably and the fluid pressure amplifier 48 could be omitted. The relation between the effective area of the intermediate diaphragm assembly 14 and the upper diaphragm assembly 13 would be changed, these areas either being more nearly equal or the area of the intermediate assembly being smaller than that of each of the outer diaphragm assemblies. In this case, the difference between the effective area of the lower diaphragm assembly 15 and the effective are of the upper diaphragm assembly 13 may be somewhat greater than 5% of the area of one of these.

When the rate of flow of air along the path 24 is changed, by changing the setting of the throttle in the blower or from any other cause, the rate of fuel flow along the passage 18 is correspondingly changed. If the rate of flow of air is increased, the pressure difference between the chambers 28 and 29 is increased and the downwardly directed force exerted on the valve member 17 is increased so that the equilibrium of the valve member 16 is lost. The valve member tends to move downwardly, thereby opening the orifice 23 further and permitting an increased rate of flow of fuel along the path 18. In consequence of this, the pressure difference between the chambers 30 and 31 is increased until the upwardly directed force exerted on the valve member is exactly equal once more to the downwardly directed force and the valve member assumes an equilibrium condition in a new position relative to the body 11. If the rate of flow of air along the path 24 is decreased, the equilibrium of the valve member 16 is lost once more, until the rate of flow of fuel also has been reduced by a corresponding amount.

If, whilst the rate of flow of air is maintained constant, there is a change tending to reduce the rate of flow of fuel, for example an increase in the back pressure from the burner or a decrease in the output of the pump 3, the pressure drop across the orifice 49 will fall and equilibrium of the valve member 16 will be lost. The valve member will move downwardly, opening the orifice 23 further, until the pressure drop across the orifice 49 is restored. The valve member will then resume equilibrium at a new position relative to the body 11. Thus, the rate of flow of fuel will be maintained constant.

If there is a tendency for the rate of flow of fuel to increase relative to the rate of flow of air, the equilibrium of the valve member will be lost until it assumes a new position relative to the body 11 which establishes the required relation between the flow rates. It will be noted that the regulating device is able to compensate for changes in conditions in either of the air flow path 24 and the fuel flow path 18. This is in contrast with known devices intended for controlling the rate of flow of fuel to a burner, for example the devices disclosed in U.S. Pat. No. 3,101,897 and in British Pat. No. 120,076 hereinbefore mentioned which do not compensate for changes in conditions in the fuel flow path.

In the example illustrated, the valve seat 22 is screwed into a bore in an adjacent part of the body in a direction from the chamber 31 towards the exterior of the body. The body may be modified so that the valve seat can be screwed into the body in the opposite direction, the external wall of the body being provided with an access opening normally closed by a plug. The head 19 of the valve also may be demountable from the valve member so that the valve head can be withdrawn through the access opening, when the plug has been removed.

It will be noted that the means defining the air orifice 25 are disposed outside the body 11. Although the means defining the fuel orifice 49 is represented in the drawing as being outside the body 11, this orifice may be provided in the device 10. The fuel orifice is spaced along the fuel flow passage from the valve orifice 23. It will further be noted that fluid is admitted to each of the chambers 28 to 31 through an opening in a fixed wall of that chamber defined by a respective part of the body 10. To avoid resistance to movement of the valve member 16 arising from deflection of the diaphragms, the diaphragms are of roll-up form.

In the example illustrated, the effective area of the intermediate diaphragm assembly is approximately 17 times the effective area of each outer diaphragm assembly. The ratio between the area of the intermediate diaphragm assembly and the area of one outer diaphragm assembly may be increased to a value such that the pressure amplifier is not required and the chambers 28 and 29 can be connected directly with the air flow path.

What is claimed is:

1. An apparatus for controlling the flow of fuels of varying viscosity at various pressures in order to maintain a predetermined fuel to air ratio to a burner comprising:

(a) a first conduit means for directing air to the burner having a flow restrictive means therein to separate the first conduit means into high and low pressure sections;

(b) a second conduit means for directing fuel to the burner having flow restrictive means therein to separate the second conduit means into high and low pressure sections;

(c) fuel flow regulating means comprising (i) a hollow body, (ii) a valve member disposed within the body and reciprocally moveable therein, having a valve stem with a valve head on the end thereof, and (iii) three annular, coaxial diaphragm assemblies disposed within the hollow body including a pair of outer diaphragm assemblies and an intermediate diaphragm assembly disposed therebetween, the diaphragm assemblies sealingly mounted about the outer periphery thereof to the hollow body and by the inner peripheries thereof to the valve member, the intermediate and each of the outer diaphragm assemblies in conjunction with the hollow body forming first and second isolated intermediate chambers, respectively above and below the intermediate diaphragm assembly and each of the outer diaphragm assemblies forming in conjunction with the hollow body first and second isolated outer chambers;

(d) a third conduit means in fluid communication with a fuel source and the first outer chamber and having a valve orifice and a valve seat therein adapted to receive the valve head of the valve member to control the flow of fuel from the source thereof to the first outer chamber;

(e) a fourth conduit means in fluid pressure transmitting relationship between the first isolated intermediate chamber and the high pressure section of the first conduit means without fluid flow therethrough;

(f) a fifth conduit means in fluid pressure transmitting relationship with the second isolated intermediate chamber and the low pressure section of the first conduit means without fluid flow therethrough; and (g) a sixth conduit means in fluid communication between the second outer chamber and the low pressure section of the second conduit means.

2. An apparatus as set forth in claim 1, wherein the fuel flow regulating means includes a biasing means to counteract the weight of the valve means.

3. An apparatus as set forth in claim 2, wherein the biasing means comprises a pair of springs associated with the valve means at the same end, at least one of the springs being expansively biased.

4. An apparatus as set forth in claim 1, further comprising pressure amplification means associated within the fourth conduit means and the fifth conduit means.

5. Apparatus according to claim 1, wherein the effective areas of the outer diaphragm assemblies differ by an amount just sufficient to compensate for the effect of unbalanced pressures in the fuel acting on the valve member.

6. An apparatus for controlling the flow of fuels of varying viscosity at various pressures in order to maintain a predetermined fuel to air ratio to a burner as set forth in to claim 1, wherein the effective area of the intermediate diaphragm assembly is several times greater than the effective area of each outer diaphragm assembly and the corresponding area of the valve head is several times smaller than the effective area of each outer diaphragm assembly.

7. Apparatus according to claim 6, wherein said valve seat and the body are provided with respective screw threads for holding the valve seat removably in the body, wherein said valve head is removably mounted on the valve stem and wherein the body defines an access opening through which the valve head can be withdrawn, when demounted from the stem, a removable plug being provided for normally closing the access opening.

8. Apparatus according to claim 7, wherein the valve member has a single valve head and the body defines a single valve orifice in the fuel passage.

* * * * *